US005647961A

United States Patent [19]

Lofland

[11] Patent Number: 5,647,961

[45] Date of Patent: Jul. 15, 1997

[54] REFRIGERANT DECONTAMINATION AND SEPARATION SYSTEM

[75] Inventor: Spencer G. Lofland, Kilgore, Tex.

[73] Assignee: Tom Nicol, Grapeland, Tex.

[21] Appl. No.: 406,384

[22] Filed: Mar. 17, 1995

[51] Int. Cl.[6] ..... B01D 3/42

[52] U.S. Cl. ..... 203/2; 203/1; 203/40; 203/87; 203/DIG. 4; 203/DIG. 18; 202/158; 202/160; 62/84; 62/475

[58] Field of Search ..... 203/40, 87, DIG. 18, 203/DIG. 4, 1, 2; 95/209; 202/158, 160, 186; 62/84, 74, 85, 119, 292, 474, 475, 621

[56] References Cited

U.S. PATENT DOCUMENTS 5,189,882 3/1993 Morgan, Sr. ..... 62/77
5,377,499 1/1995 Zvgibe ..... 62/195
5,442,930 8/1995 Stieferman ..... 62/85
5,465,590 11/1995 Van Steenburgh, Jr. et al. ..... 62/195

FOREIGN PATENT DOCUMENTS 3127836 2/1983 Germany .

*Primary Examiner*—Nina Bhat
*Attorney, Agent, or Firm*—Vinson & Elkins

[57] ABSTRACT

A system for decontaminating and separating individual refrigerants from a mixture of refrigerants contaminated with solids, liquids and non-condensible gasses, includes three stages. In the first stage, solid and liquid contaminants are removed. In the second stage, the mixture of refrigerants passes through a condensation column where successive condensation stages remove individual refrigerants from the mixture of refrigerants. The remaining mixture of refrigerants passes through a third stage where non-condensible gas contaminants are removed.

7 Claims, 11 Drawing Sheets

REFRIGERANT DECONTAMINATION AND SEPARATION SYSTEM

FIELD OF THE INVENTION

The present invention pertains to refrigerant recycling and reclaiming systems; more particularly, the system of the present invention pertains to refrigerant recycling and reclaiming systems which both decontaminate and separate individual refrigerants from a mixture of various types of refrigerants that has been contaminated by solids, liquids and non-condensible gasses.

BACKGROUND OF THE INVENTION

Environmental considerations have necessitated collecting used refrigerants from air conditioners and other types of cooling devices. Before these environmental considerations became important, used refrigerants were simply released into the earth's atmosphere. However, concerns over the integrity of the earth's ozone layer have produced government legislation and administrative agency regulations which require that used refrigerants be captured.

In future years, government legislation and administrative agency regulations will eventually terminate the production and thus the supply of new, but still potentially environmentally hazardous, refrigerants. It has therefore become necessary not only to capture used refrigerants but whenever possible, recycle and reclaim them. For example, such recycling and reclaiming will be extremely important for refrigerants such as R12 because approximately 140 million automobiles use R12 refrigerant in automobile air conditioners and approximately 150 million households have appliances such as refrigerators that use R12 refrigerant.

Unfortunately, those who service air conditioners and coolers that use refrigerants such as R12 do not segregate the various types of refrigerants used in different types of equipment if the refrigerants must be removed from the equipment during repair or maintenance. Rather, service personnel typically mix all types or grades of used refrigerants in a single container. Not only does this mixing of refrigerants render all the used refrigerants unusable, it also contaminates the entire mixture of used refrigerants with small solid particles of dirt or debris; liquids such as water, oil or acid; and non-condensibles such as air or nitrogen that may have been present in only one of the used refrigerants.

For used refrigerants to be recycled, reclaimed and rendered re-usable, it is necessary that the used refrigerants be decontaminated and separated; that is, they must be cleansed of any solid, liquid or gaseous contaminants and then selectively separated into pure individual refrigerants. To facilitate such recycling and reclaiming of refrigerants, it is necessary to provide a system which implements a process capable of both separating out the individual refrigerants, one from another, and also removing any solid, liquid or gaseous contaminants.

SUMMARY OF THE INVENTION

A system for decontaminating, separating and reclaiming individual refrigerants from a mixture of various types and grades of refrigerants which has been contaminated with solids, liquids and non-condensible gasses, includes three steps. First, the solid and liquid contaminants such as dirt, debris, water, acid and oil are removed from the mixture of refrigerants by a distillation and drying process. The removed contaminants are then properly disposed of. Second, the vaporous mixture of refrigerants is run through a column of successive condensation stages where individual refrigerants are selectively separated from the mixture by condensation into liquid form. Individual liquid refrigerants are then removed from the mixture of refrigerants, which continues on through successive condensation stages in the condensation column. Third, any remaining vaporous refrigerants are then re-condensed so that non-condensible contaminants, such as air or nitrogen, can be removed, collected and properly disposed of.

BRIEF DESCRIPTION OF THE DRAWINGS

A better understanding of the system for decontaminating, separating and reclaiming individual refrigerants from a contaminated mixture of refrigerants of the present invention may be had by reference to the following figures wherein:

DESCRIPTION OF THE EMBODIMENTS

Used refrigerants, including various types of refrigerants, such as R12 refrigerant, commonly used with automobile air conditioning systems, R22 refrigerant commonly used with residential air conditioning systems, and various other types of refrigerants such as R123, R134, R500, R502 and R503 used in all types of industrial applications are mixed together by service personnel after having been removed from cooling equipment. This mixture of used refrigerants is often contaminated with dirt, debris, oil, acid, water, nitrogen or air picked up by even just one of the refrigerants in the mixture. As concerns over the integrity of the earth's ozone layer have rendered it impermissible to dispose of used refrigerants by releasing them into the atmosphere, it has become necessary to reclaim used refrigerants. And because future production of new refrigerants, which may be hazardous to the integrity of the earth's ozone layer, is being phased out, it has become necessary to recycle and reclaim used refrigerants to preserve the operability of present-day air conditioners and cooling equipment which require older types of refrigerants, such as R12.

Figure 1:
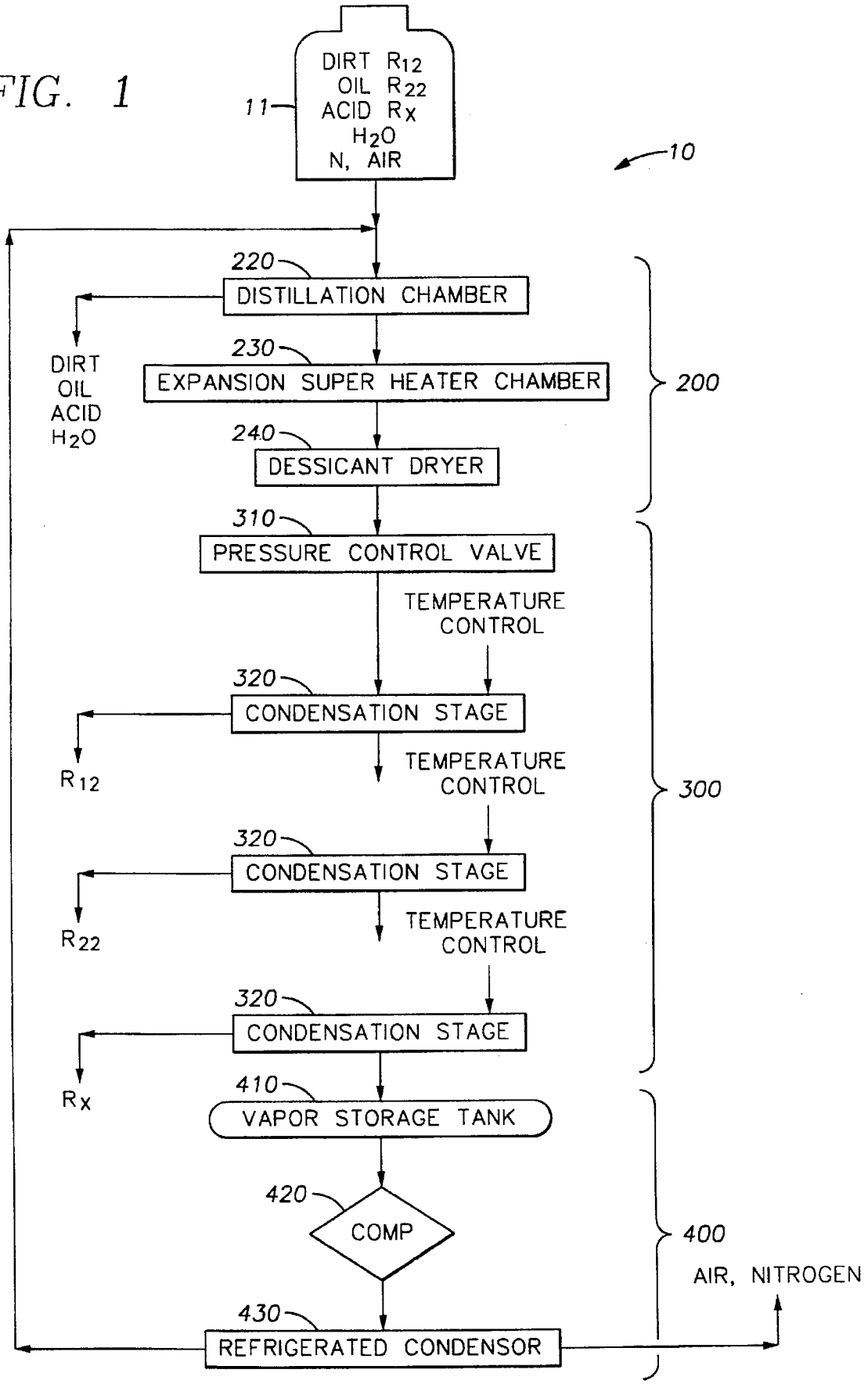
FIG. 1 is a block diagram of the system of the present invention.

The refrigerant decontamination, separation and reclamation system 10 of the present invention implements a three-step process. First, as shown in FIG. 1, contaminated mixed refrigerants 11, obtained from various sources, are contained in a single container. Solid and liquid contaminants are removed in the first phase 200. Second, successive condensation stages in the condensation column 300 selectively separate the individual refrigerants from the mixture. Finally, the gaseous, non-condensible contaminants are removed in the final stage 400.

By further reference to FIG. 1, it may be seen that the contaminated mixture of refrigerants first passes through a distillation chamber 220. In the distillation chamber 220, dirt, debris, oil, water and acids are separated from the mixture of refrigerants and properly disposed of. The distillation chamber 220 operates at approximately 100 degrees Fahrenheit. At 100 degrees Fahrenheit the mixed refrigerants are in a vapor state, and the contaminating oil, water and acids are liquids. Following the heating of the mixture of refrigerants and the separation of the solid and liquid contaminants by the distillation chamber 220, the mixture of refrigerants passes on to an expansion superheater chamber 230, which operates at approximately 110 degrees Fahrenheit. The expansion superheater chamber 230 allows any liquid particles remaining in the distilled vapors of the mixture of refrigerants to expand or vaporize. If these liquid particles contain any contaminants, such as oil or water, the liquid particles will be trapped for eventual drainage back into the distillation chamber 220 where they can be properly disposed of. Next the refrigerant vapor passes through a desiccant dryer 240 where any remaining moisture is removed.

After exiting the desiccant dryer 240 the mixture of refrigerants then passes on to the successive stages in the condensation column 300. The condensation column 300 includes a plurality of condensation stages 320 which operate at successively cooler temperatures. As the mixture of refrigerants passes through the condensation column 300, the successively cooler temperatures at each condensation stage 320 cause pure individual refrigerants to be distilled from the mixture of refrigerants, thus allowing these pure individual refrigerants to be separated from the mixture of refrigerants and collected. As shown, by example, in FIG. 1 are two common refrigerants, R12 and R22. R symbolizes other refrigerants which can be selectively separated. It has been found that a single individual refrigerant may be condensed at several stages of the condensation column 300. This is because a single refrigerant, such as R12, may change state from a vapor to a liquid at several different temperature levels.

The pressure of the vaporous mixture of refrigerants passing through the successive condensation stages 320 is kept at a constant level by a pressure control valve system 310. As the various individual refrigerants are distilled from the mixture of refrigerants, they exit the various condensation stages in liquid form. Individual liquid refrigerants liquid are separated from the vaporous mixture of refrigerants in a distillate separation chamber. The liquid refrigerant is then further transferred to a storage chamber which eventually empties into large containers of pure recycled and reclaimed refrigerant.

Any remaining mixture of refrigerants left over, after passing through the condensation column 300, continues on to the third phase 400 which removes any non-condensible contaminants, such as air or nitrogen. Herein, the remaining mixture of refrigerants first passes into a vapor storage tank 410, and thence through a compressor 420 where the mixture of refrigerants is in a substantially vapor phase. The mixture of refrigerants exits the compressor 420 in a predominantly vapor phase and is piped to a condensation chamber 430. In the condensation chamber 430, any remaining refrigerants are distilled from the mixture of refrigerants and then recycled back through the system. Non-condensible contaminants such as air and nitrogen are separated from the distilled refrigerants, collected in a chamber and properly disposed of.

Figures 2, 5:
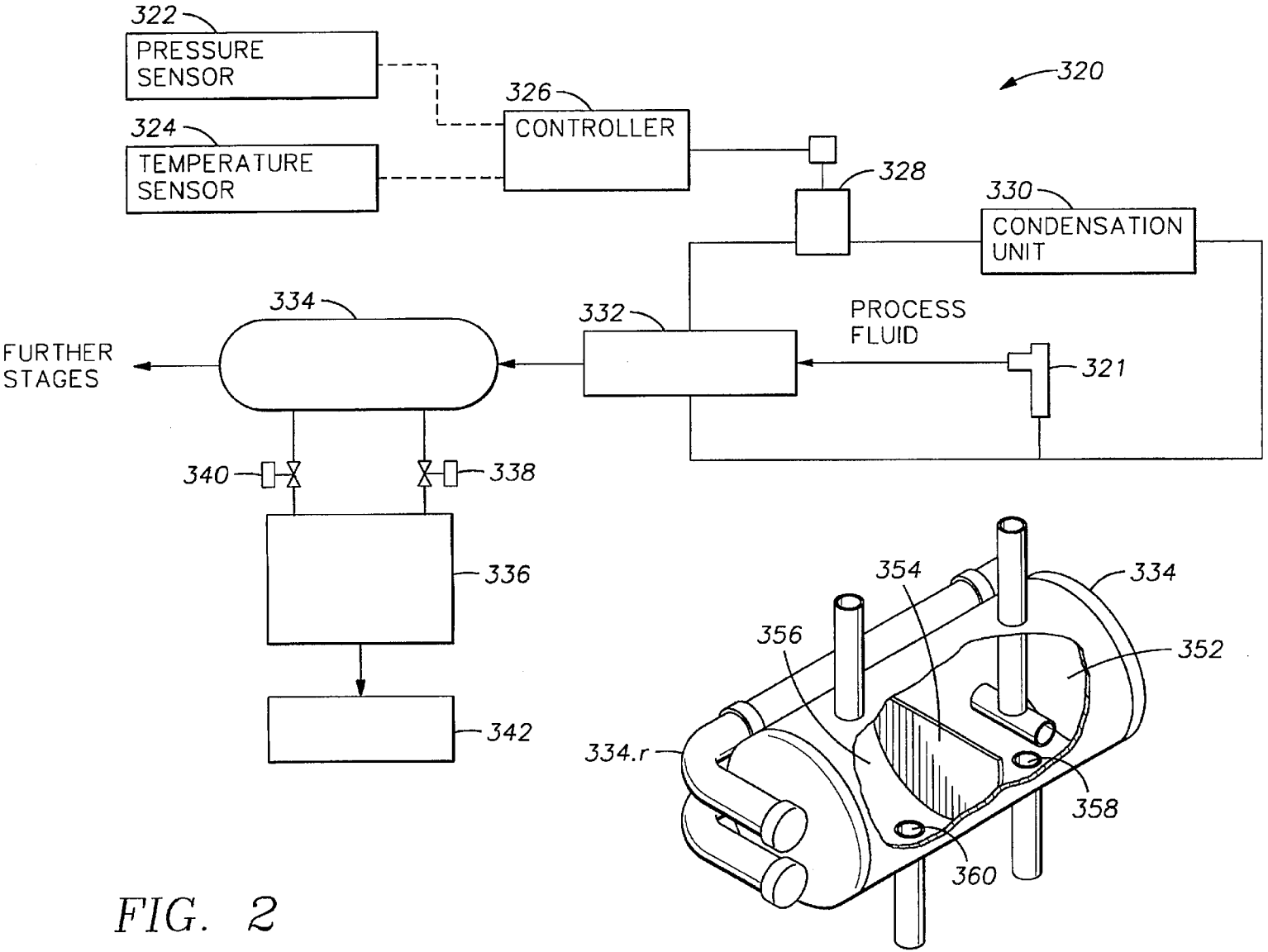
FIG. 2 is a schematic diagram of a typical stage in the condensation column which selectively separates individual refrigerants from the mixture of refrigerants.
FIG. 5 is a perspective view of the distillate separation chamber used in the successive condensation stages in the condensation column.

As the heart of the refrigerant decontamination and separation system of the present invention is the condensation column 300, a typical condensation stage 320 within condensation column 300 will be explained in more detail, by specific reference to FIG. 2. In FIG. 2, it may be seen that the flow of the mixture of refrigerants into the condensation stage 320 is monitored by a flow-control valve 321. The temperature of the refrigerating refrigerant used in a condensing stage 320 to condense the mixture of refrigerants passing through the condenser column 332 is maintained at the correct level by a controller 326. The controller 326 receives electrical signals based on a measurement of the temperature of the mixed refrigerants 324 and the pressure of the mixture of refrigerants 322. The controller 326 determines the amount of refrigerating refrigerant to be supplied to the condenser column 332 from the condensation unit 330. A signal is then sent by the controller 326 to a solenoid operated gas injection valve 328. Valve 328 opens for the required time to allow the proper amount of refrigerating refrigerant to pass from the condensing unit 330 into the condenser column 332.

Once the desired individual refrigerant has been distilled or condensed out of the mixture of refrigerants, the individual refrigerant then passes to a distillation separation chamber 334. As may be seen in FIG. 5 the distillation separation chamber 334 separates liquid refrigerant from vaporous refrigerant. Liquid refrigerant enters a chamber 352 and is retained therein by a baffle 354. Vaporous refrigerant passes over the baffle 354 into a chamber 356. Liquid refrigerant passes out an opening 358 in the chamber 352 while vaporous refrigerant exits the chamber 356 through a tube 361. Such construction of the distillation chamber 334 allows for the passage of liquid refrigerant to a distillate storage tank 336 through solenoid valve 338 and a refrigerant vapor return 360 through a solenoid valve 340. From the distillation storage tank 336, the individual refrigerant is piped to a chilled collection container 342.

Figure 3A:
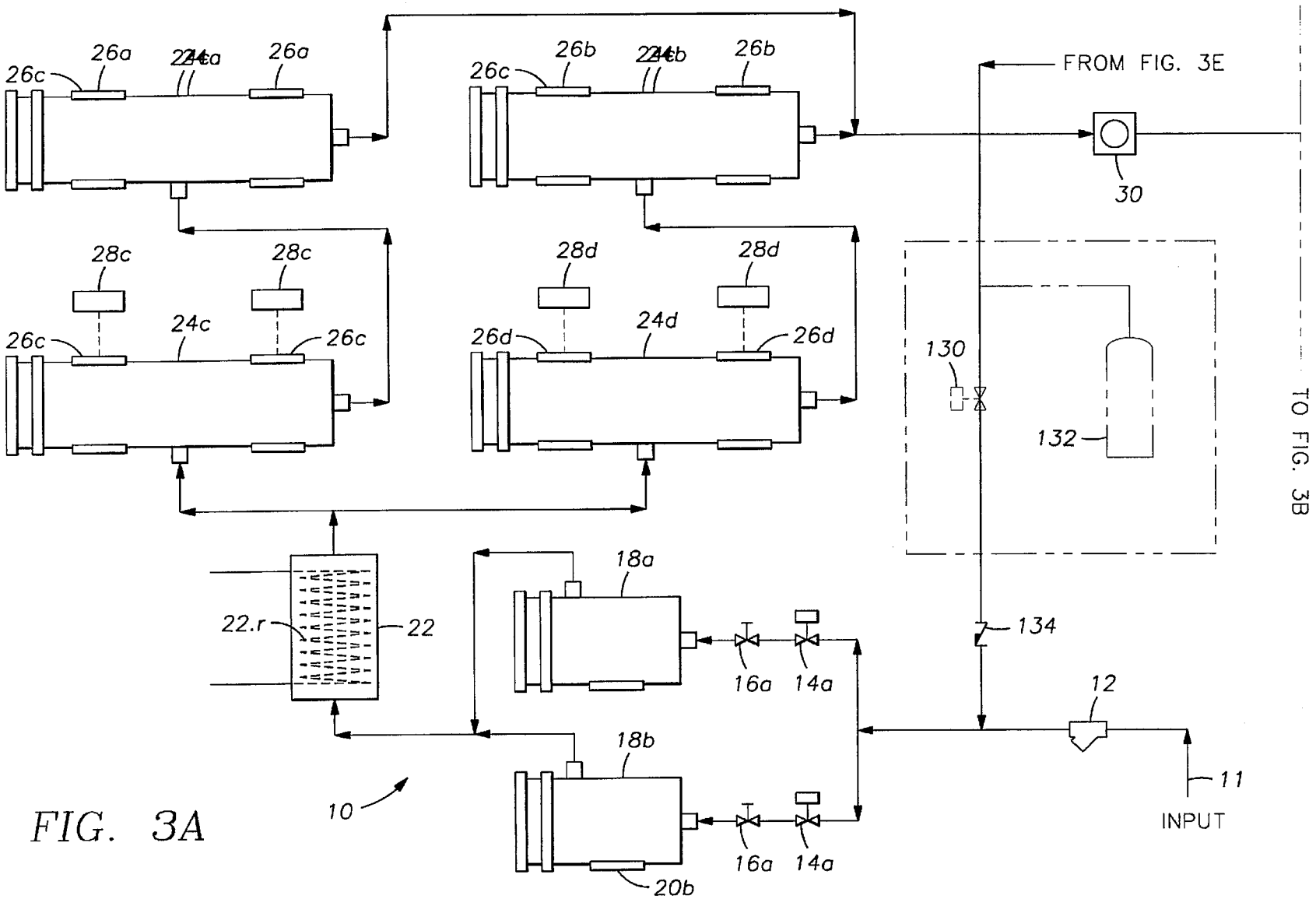
FIGS. 3A, 3B, 3C, 3D, 3E are sections of a flow diagram of one embodiment of an operational system for processing a contaminated mixture of refrigerants.

In FIG. 3A, an operational embodiment of the system of the present invention is illustrated. Components having similar construction and location have the same reference number. Letter suffixes a–n are used to locate components with respect to the 14 condensate stages within the system. Contaminated mixed refrigerants 11 pass into the system 10 of the present invention through a strainer 12. Once passing through the strainer 12, the contaminated mixture of refrigerants is piped to two distillation chambers **18*a* and 18*b*, through two solenoid valves 14*a* and 14*b*, and two manual pressure regulating valves 16*a* and 16*b*. In the operational embodiment illustrated, two distillation chambers 18*a* and 18*b* are used; however, it will be understood by those of ordinary skill in the art that the two distillation chambers 18*a* and 18*b*** in the preferred embodiment may be replaced by a single distillation chamber if proper flow capacity is provided.

The two distillation chambers **18*a* and 18*b* are kept at a temperature of approximately 100 degrees Fahrenheit by two heaters 20*a* and 20*b*. As the mixed refrigerants are in a vapor state within the two distillation chambers 18*a* and 18*b*, and contaminants such as water, oil and acid are in a liquid state, these contaminants are removed from the mixture of refrigerants by the two distillation chambers 18*a* and 18*b*** and properly disposed of. Any dirt or debris in the mixture of refrigerants is captured by the liquid contaminants and removed therewith.

Once exiting the two distillation chambers **18*a* and 18*b* the mixture of refrigerants is then piped to a superheater expansion chamber 22 which is kept at 110 degrees Fahrenheit by internal coils 22.r heated by refrigerating refrigerant obtained from a condenser unit 41 (FIG. 4**).

Once exiting the superheater expansion chamber 22 the vaporous mixture of refrigerants is then dried. The drying operation takes place in a series of desiccant vapor dryers, 24*a*, 24*b*, 24*c* and 24*d*. In the operational embodiment illustrated, a pair of series connected dryers is connected in parallel to dry the vaporous mixture of refrigerants. Other flow arrangements may be used as long as the requisite flow capacity is provided. Note that two of the desiccant vapor dryers are temperature controlled by two thermostats 28*c* and 28*d*, respectively. These two thermostats 28*c* and 28*d* control two heaters 26*c* and 26*d*. In addition, the other two desiccant vapor dryers 24*a* and 24*b* are also temperature controlled by two heaters 26*a* and 26*b*.

Following the exit of the vaporous mixture of refrigerants from the desiccant dryers 24*a*, 24*b*, 24*c* and 24*d*, the vaporous mixture of refrigerants is then piped through a sight glass 30. As explained with reference to FIGS. 1 and 2, a plurality of individual condensation stages 320 make up the condensation column 300. In the operational embodiment shown in FIGS. 3A through 3E individual heat removers or condenser columns 58 in condensation stages 320 have been paired together. Similar hardware items have the same reference numbers. Letter suffixes locate components with respect to the 14 condensate stages within the system. As will be explained later, the operational embodiment of the present invention shown in FIGS. 3A through 3E has been designed to process both high and low-pressure refrigerants. Initially, the operation of the refrigerant decontamination and separation system of the present invention will be explained for high-pressure refrigerants. The operation of the system for low pressure refrigerants will be discussed below.

Figure 3B:
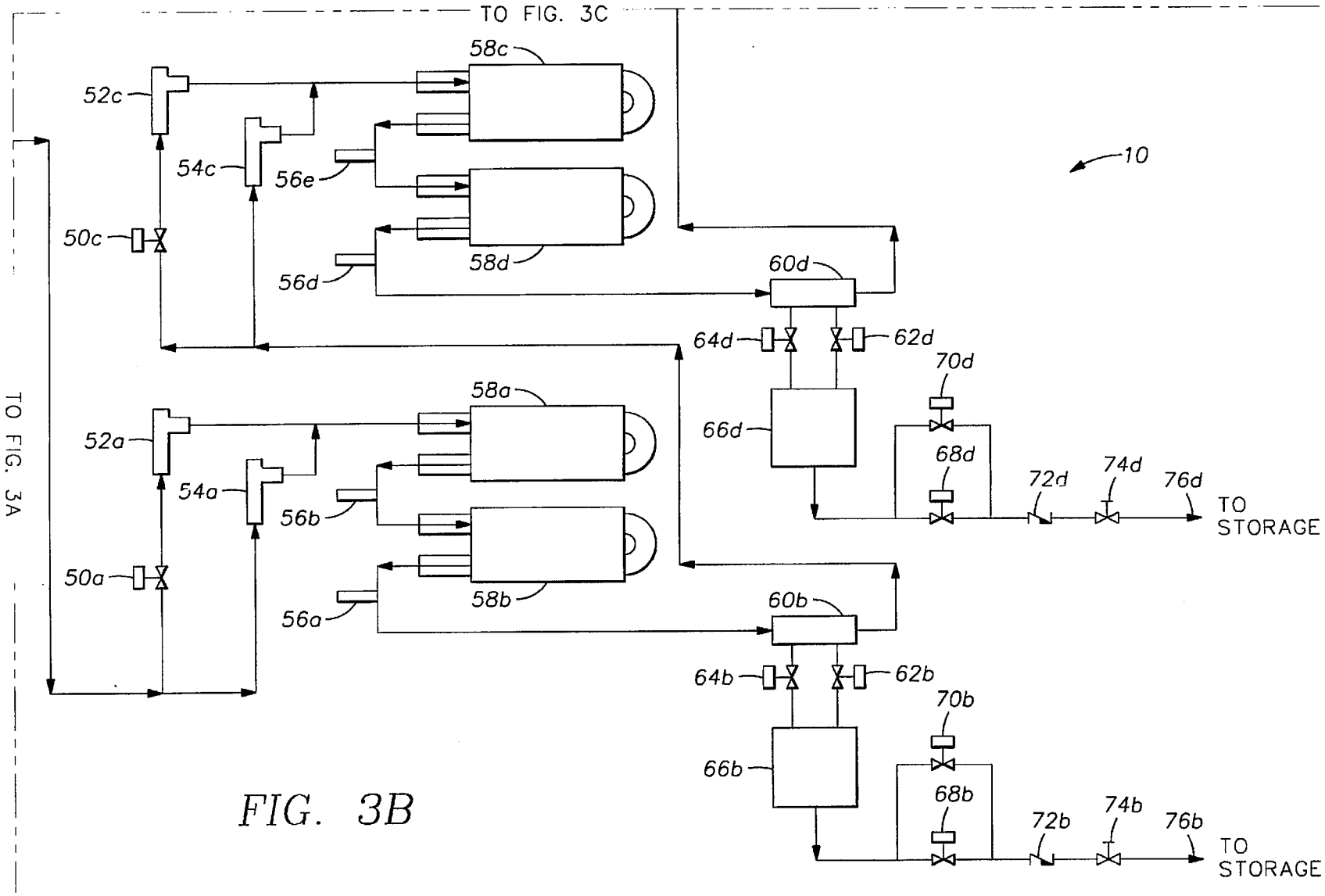

As may be seen by reference to FIG. 3B, following their passage through the sight glass 30, the vaporous mixture of refrigerants passes through a flow-control valve 54*a* en route to the first condenser column 58*a*. Once passing through the first condenser column 58*a*, the mixture of refrigerants passes through a second condenser column 58*b*. The pressure of the mixture of refrigerants passing through the condenser columns 58*a* and 58*b* is monitored by two pressure transducers 56*a* and 56*b*. The two transducers 56*a* and 56*b* send an electrical signal corresponding to the pressure of the mixed refrigerants to a controller 326 (FIG. 2). The controller 326 assures that the condenser columns 58*a* and 58*b* are maintained at the proper temperature to selectively separate out the desired individual liquid refrigerant from the mixture of refrigerants.

Once exiting the second condenser column 58*b*, the distilled individual liquid refrigerant is piped to a distillate separation chamber 60*b* whose construction is illustrated in FIG. 5. At the distillate separation chamber 60*b*, the individual distilled liquid refrigerant is separated from the mixture of refrigerants. A solenoid valve 62*b* controls the flow of the individual liquid refrigerant to a distillate storage chamber 66*b*. A level sensor (not shown) within the distillate storage chamber 66*b* provides a signal to a solenoid valve 68*b* to drain the distillate storage chamber 66*b*.

It should be noted that as the distilled individual liquid refrigerant leaves a condenser column, generally 58, and enters a distillate separation chamber, generally 60, before passing into a distillate storage chamber, generally 66, there is a small increase in temperature of the distilled individual liquid refrigerant. This small increase in temperature helps to remove any lower boiling point refrigerants, that is, any unwanted refrigerant which is still mixed in with the targeted refrigerant. The unwanted refrigerant will then be released as a vapor and travel on to the next set of condenser columns.

The opening of solenoid valve 68*b* allows the individual distilled liquid refrigerant to pass through check valve 72*b*, a manual control valve 74*b* and quick disconnect fitting 76*b*. If it is desired to override the level sensor in the distillate storage chamber 66*b*, a solenoid valve 70*b* is opened which then bypasses the solenoid level control valve 68*b*.

After passing through the first and second condenser columns 58*a* and 58*b* the vaporous mixture of refrigerants passes on to the next two condenser columns 58*c* and 58*d*. Therein, the vaporous mixture of refrigerants passes through a flow-control valve 54*c* before entering the next two condenser columns 58*e* and 58*d*. Once again, the condensed individual liquid refrigerant is piped to a distillate separation chamber 60*d*, thence through two valves 64*d* and 62*d*, on to the distillate storage chamber 66*d*, and thence through a solenoid valve 68*d*, on through a check valve 72*d*, a manual control valve 74*d*, past a quick disconnect fitting 76*d* into a chilled collection container 66*d* for the individual distilled liquid refrigerant.

Figure 3C:
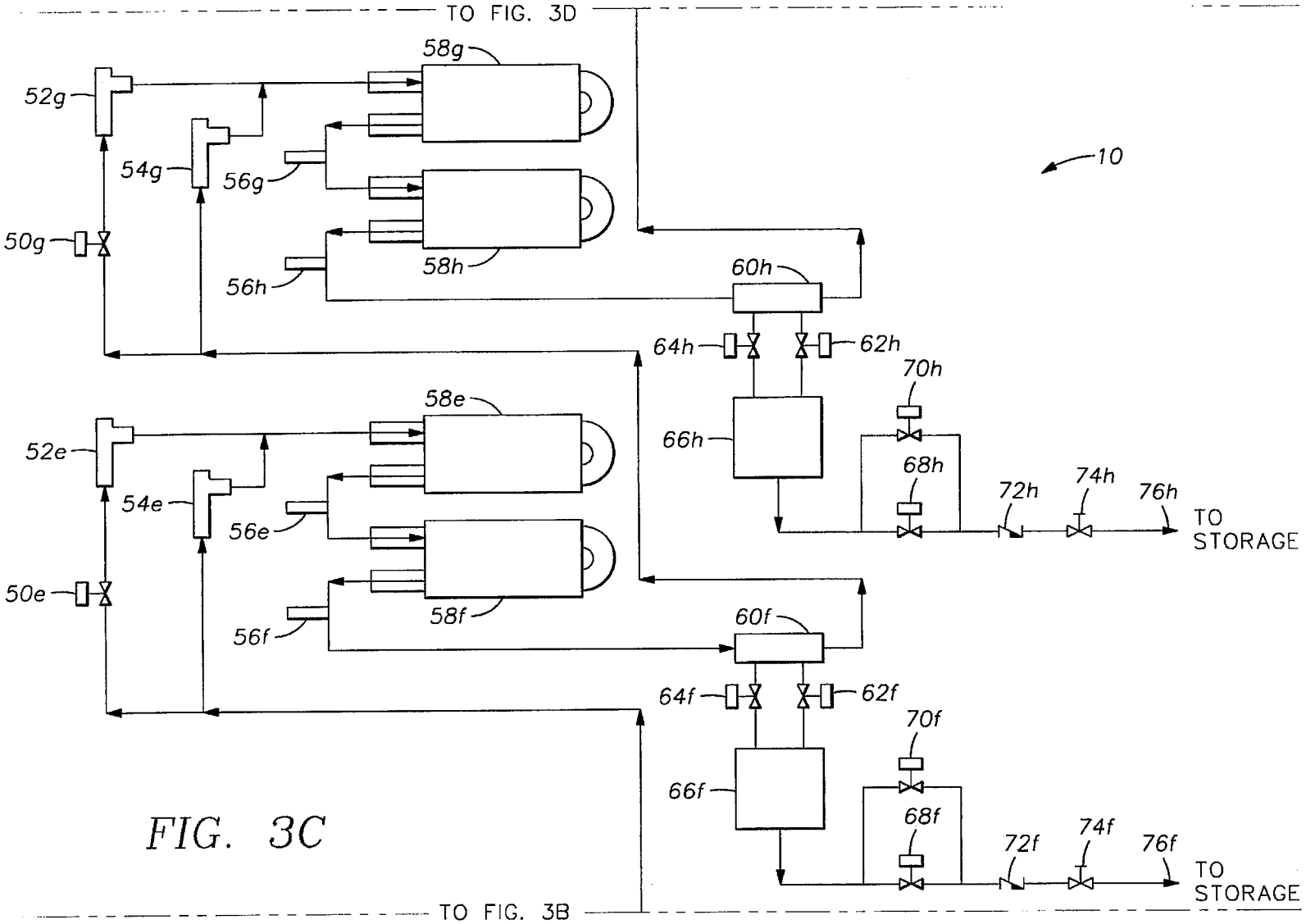
Figure 3D:
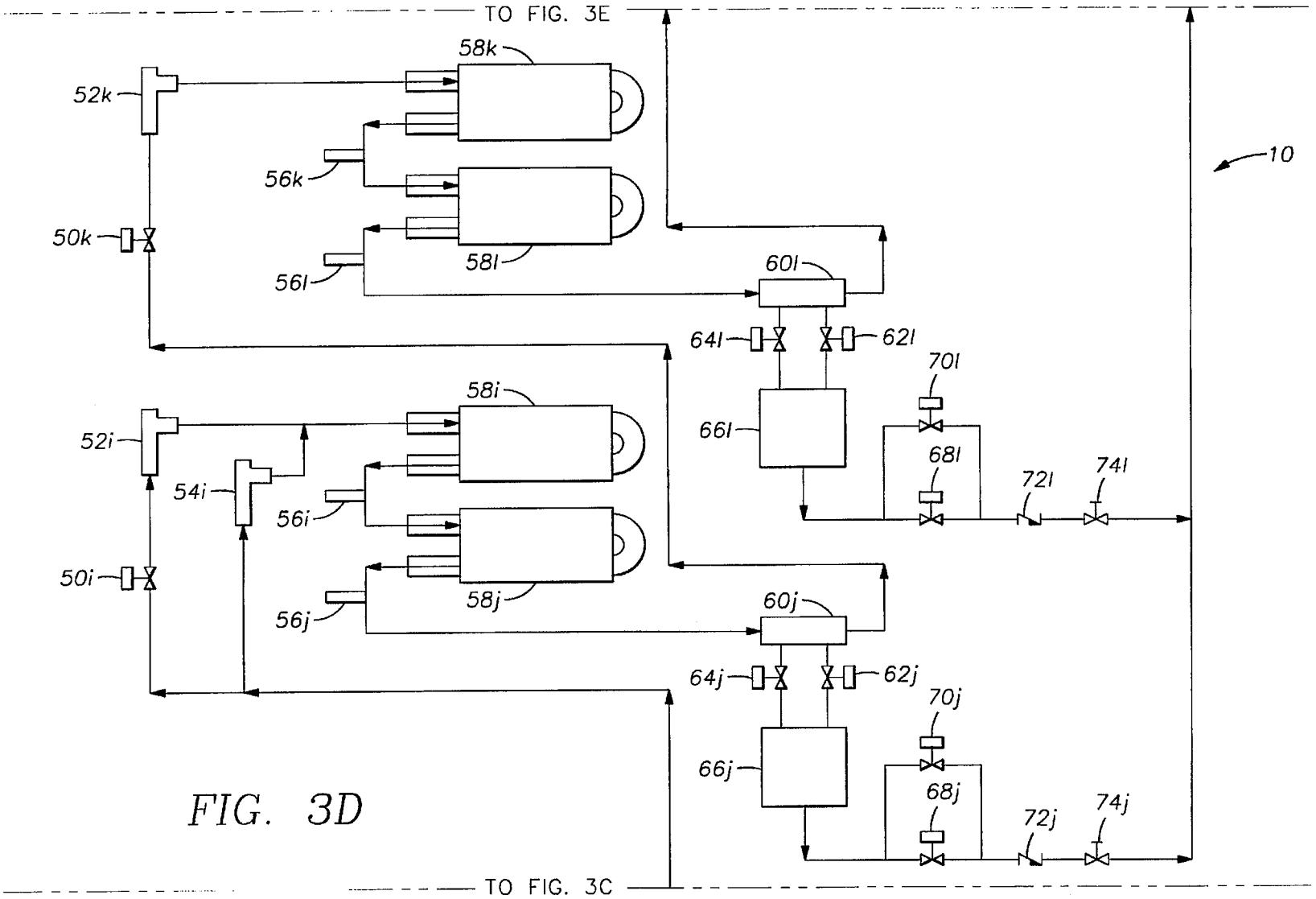
Figure 3E:
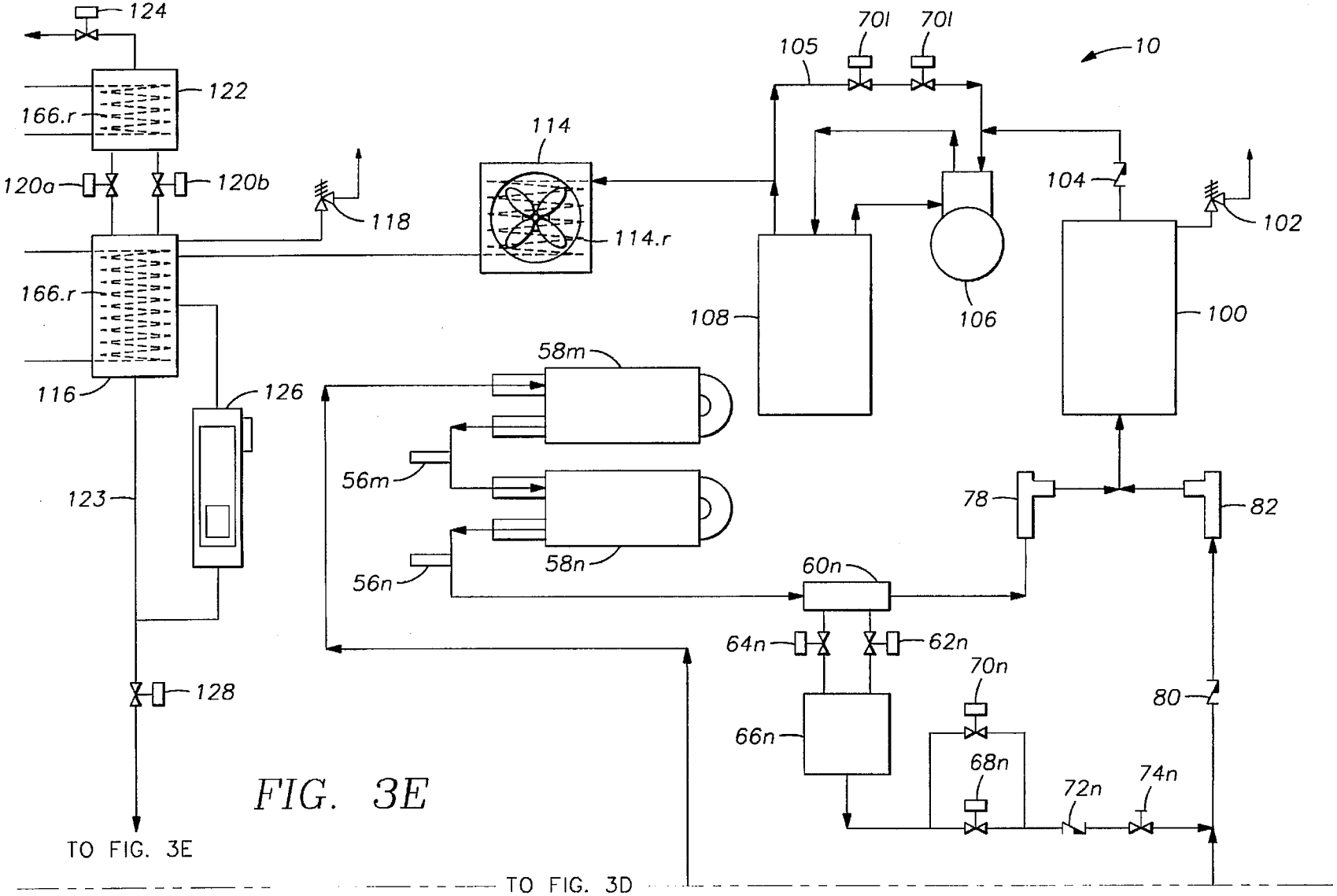

In the remaining portions of the embodiment illustrated in FIGS. 3C through 3E, the distillation column 300 includes 10 additional separate condenser columns, 58*e* through 58*n*. While any number of condensation stages 320 can be used, it has been found that the use of twenty-two condensation stages 320 provides a sufficient array of condensation temperatures such that most commonly used refrigerants may be individually separated by condensation from a mixture of refrigerants.

To enhance the effectiveness of the system 10 and to more accurately set the temperatures in column 300, it has been found that using gas chromatography techniques, to identify the various refrigerants in the mixture of refrigerants before the mixture of refrigerants is processed, enables better selection of the temperatures for the various individual condensation stages 320.

As shown in FIG. 3E, following the exit of the vaporous mixture of refrigerants from the condensation column 300, any remaining mixed refrigerant vapor is then piped to a vapor storage vessel 100. The vapor storage vessel 100 is protected by a pressure relief valve 102. From the vapor storage vessel 100, the remaining vaporous mixture of refrigerants is piped through a check valve 104 to a compressor 106. From the compressor 106, the remaining vaporous mixture of refrigerants passes through an oil separator 108 which removes any oil added to the mixture of refrigerants by the compressor 106. Following the compressor 106 the remaining mixture of refrigerants is then piped to a desuperheater coil 114 where additional heat is removed from the remaining mixture of refrigerants. The use of the desuperheater coil 114 enables reduction in the size of the condenser chamber 116 which follows and facilitates removal of the non-condensible contaminants.

The level of system pressure is controlled by a feedback loop 105 to the compressor 106. The feedback loop 105 includes a pressure controlled solenoid valve 112 and a pressure actuated discharge bypass valve 110. The discharge bypass valve 110 is open whenever the compressor 106 is running.

Any remaining vaporous mixture of refrigerants exiting the desuperheater coil 114 passes into the condenser chamber 116. A pressure relief valve 118 protects the condenser chamber 116. In the condenser chamber 116, any remaining refrigerants in the mixture are distilled into a liquid. Periodically, the remaining mixture of condensed mixed liquid refrigerants and any remaining non-condensible vapors, such as air or nitrogen, are passed through two time-controlled solenoid valves 120*a* and 120*b*. Non-condensible contaminants, such as air or nitrogen are then allowed to pass into the non-condensible contaminant collection chamber 122 and released therefrom by opening a solenoid valve 124. If any mixture of refrigerants remains, it is passed through a return loop 123 back into the system just after strainer 12 (FIG. 3A). If it is desired not to recycle the remaining mixture of refrigerants, a shunt valve 130 (FIG. 3A) is actuated and the remaining mixture of refrigerants is piped to a storage vessel 132.

It may be seen by further reference to FIG. 3E that the level of remaining mixture of refrigerants in the condenser chamber 116 is controlled by an electric liquid level control 126. The electric liquid level control 126 provides a signal to a solenoid valve 128 that enables the emptying of the condenser chamber 116 to a storage vessel 132 (FIG. 3A) or back for re-processing through a check valve 134 to the two distillation chambers 18*a* and 18*b*.

As previously stated, the system of the present invention may be used with both high-pressure and low-pressure refrigerants. If the system is used with low-pressure refrigerants, the high-pressure flow-control valves, generally bearing the reference number 54 in each pair of condensate stages, are bypassed. As may be seen in FIGS. 3B through 3D they are replaced in the lower pairs of condensate stages by low-pressure flow-control valves which bear the reference number 52. Such replacement of the high-pressure flow-control valves 54 by the low-pressure flow-control valves 52 is accomplished by the opening of the solenoid valves 50, which allow the flow of the mixture of refrigerants to pass through the low-pressure flow-control valves 52 in each pair of condensers 58.

As the downstream condensation condensers 58*k*, 58*l*, 58*m* and 58*n* in condensation column 300 are particularly designed for high-pressure refrigerants, no low-pressure flow-control valve is present. If only a mixture of low-pressure refrigerants is being processed, a solenoid valve 84 (FIG. 3D) is opened which allows the remaining vaporous mixture of refrigerants to pass directly into a vapor storage vessel 100 following the last high-pressure condenser 58*j*. If high-pressure refrigerants are being processed, the solenoid valve 84 remains closed. This causes the high-pressure refrigerants to cycle through condenser columns 58*k*, 58*l*, 58*m* and 58*n*. Flow of low-pressure vapor to the vapor storage vessel 100 is controlled by a flow-control valve 82 when low-pressure refrigerants are being processed, and by another flow-control valve 78 when high-pressure refrigerants are being processed. To prevent any backflow in the system, a check valve 80 is placed just before the flow-control valve 82.

A still further understanding of the system of the present invention for purifying and separating individual refrigerants from a mixture of refrigerants may be had by reference to FIG. 4A through 4D. Therein, flow of the refrigerating refrigerants into the equipment used to process the contaminated mixture of refrigerants is shown. The suffix ".r" is used to designate the cooling coils in the equipment used to process the mixture of contaminated refrigerants be they external as shown in FIG. 5 or internal.

The condenser columns 58 are cooled by five condenser units 32, having different letter suffixes after their reference numbers to designate their location in the condensation column 300. An analysis of the refrigerating refrigerant flow for the first two condenser columns 58*a* and 58*b* (FIG. 4A) indicates that the refrigerating refrigerant from a condenser unit 32*a* first passes through solenoid temperature control valves 328*a*, 328*b*. The solenoid temperature control valves 328*a*, 328*b* receive a signal to either open or close from the controller 326 (FIG. 2). The controller 326 receives its input signals from both the temperature and pressure of the mixture of refrigerants being processed. The output signal from the controller 326 governs the opening and closing of the solenoid temperature control valves 328*a*, 328*b*. While in the illustrated embodiment the temperature control valves 328 are opened for specified short periods of time, it is possible to use proportioning valves which are open not only for specified periods of time but have adjustable flow rates.

Refrigerating refrigerant from the various condenser units 32, once having passed through the solenoid valves 328, is piped through individual expansion valves 40 which are controlled by the expansion valve sensors 38. The expansion vanes 40 are configured so as to allow incoming refrigerant, gaseous or liquid, to expand to a predominately gaseous state. The refrigerating refrigerant used to remove heat from the condenser columns 58*a* and 58*b* is joined at a manifold 36 and then passed through the coils 60.r which surround each distillate separation chamber 60. The refrigerating refrigerant, once having passed through the coils 60.r surrounding the distillate separation chamber 60, passes through the coils 66.r contained in the distillate storage chamber 66 and then is returned to the condenser unit 32.

Figure 4A:
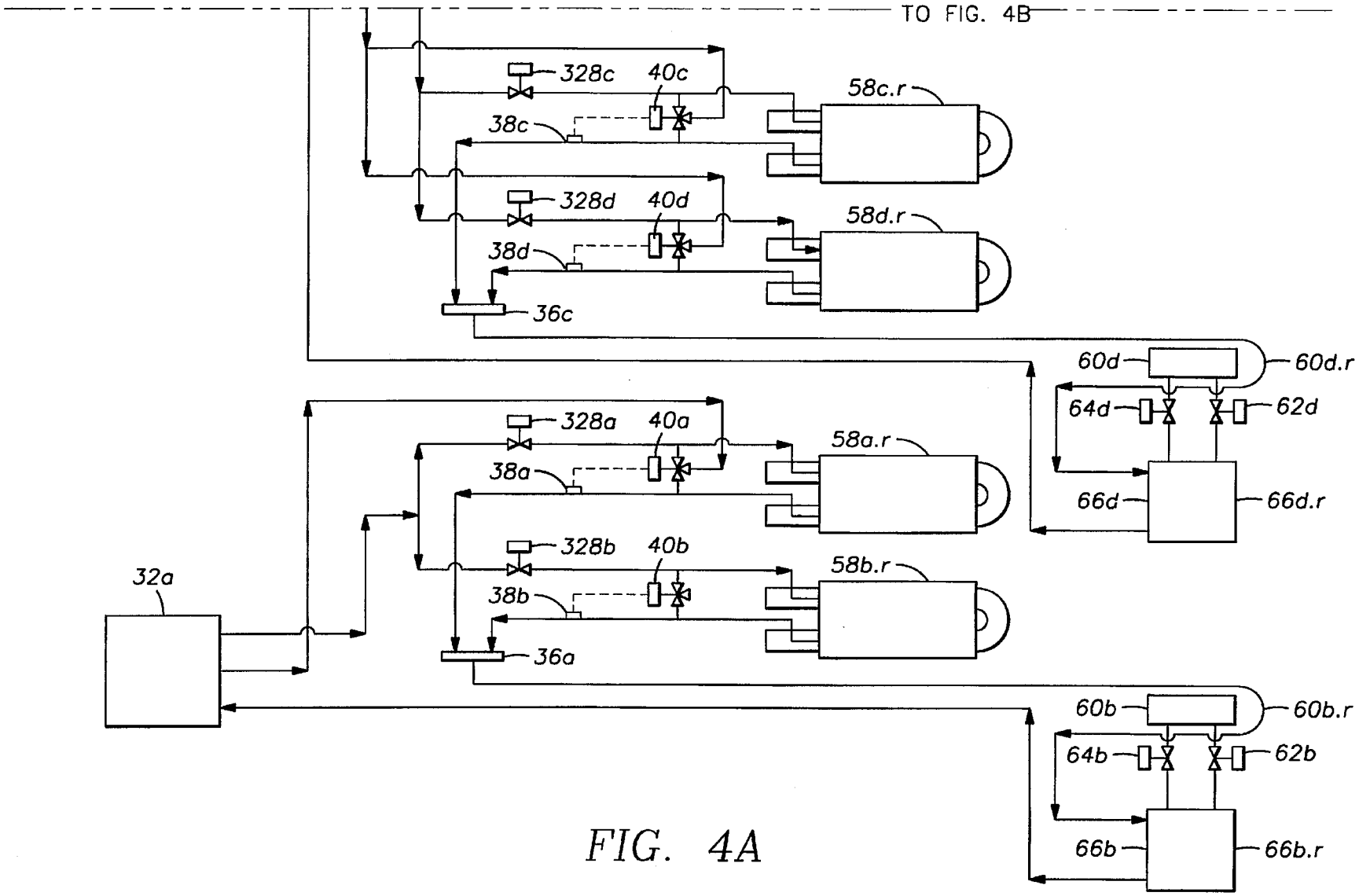
FIGS. 4A, 4B, 4C and 4D are sections of a flow diagram illustrating how refrigerating refrigerant is used to operate the system of the present invention.
Figure 4B:
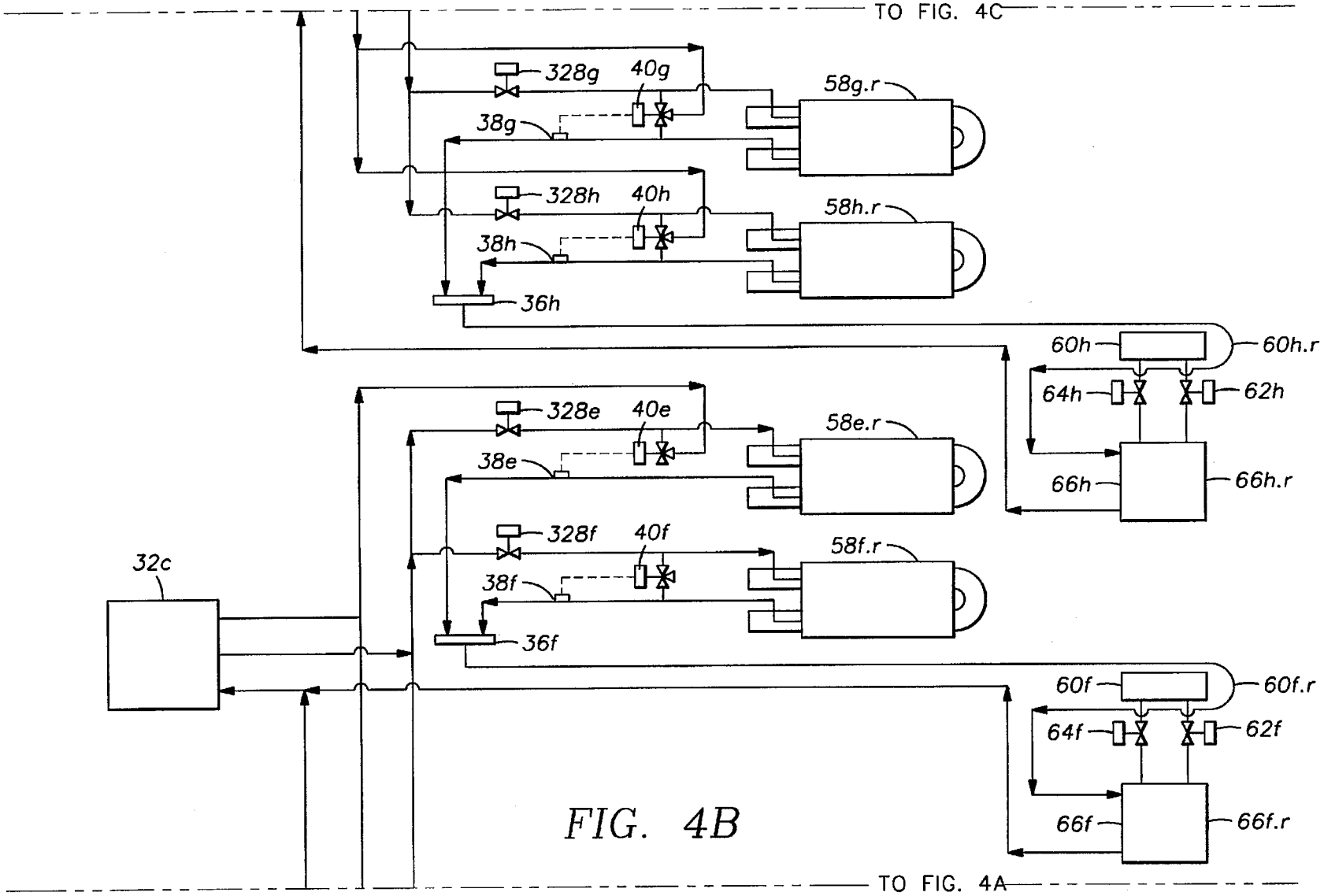
Figure 4C:
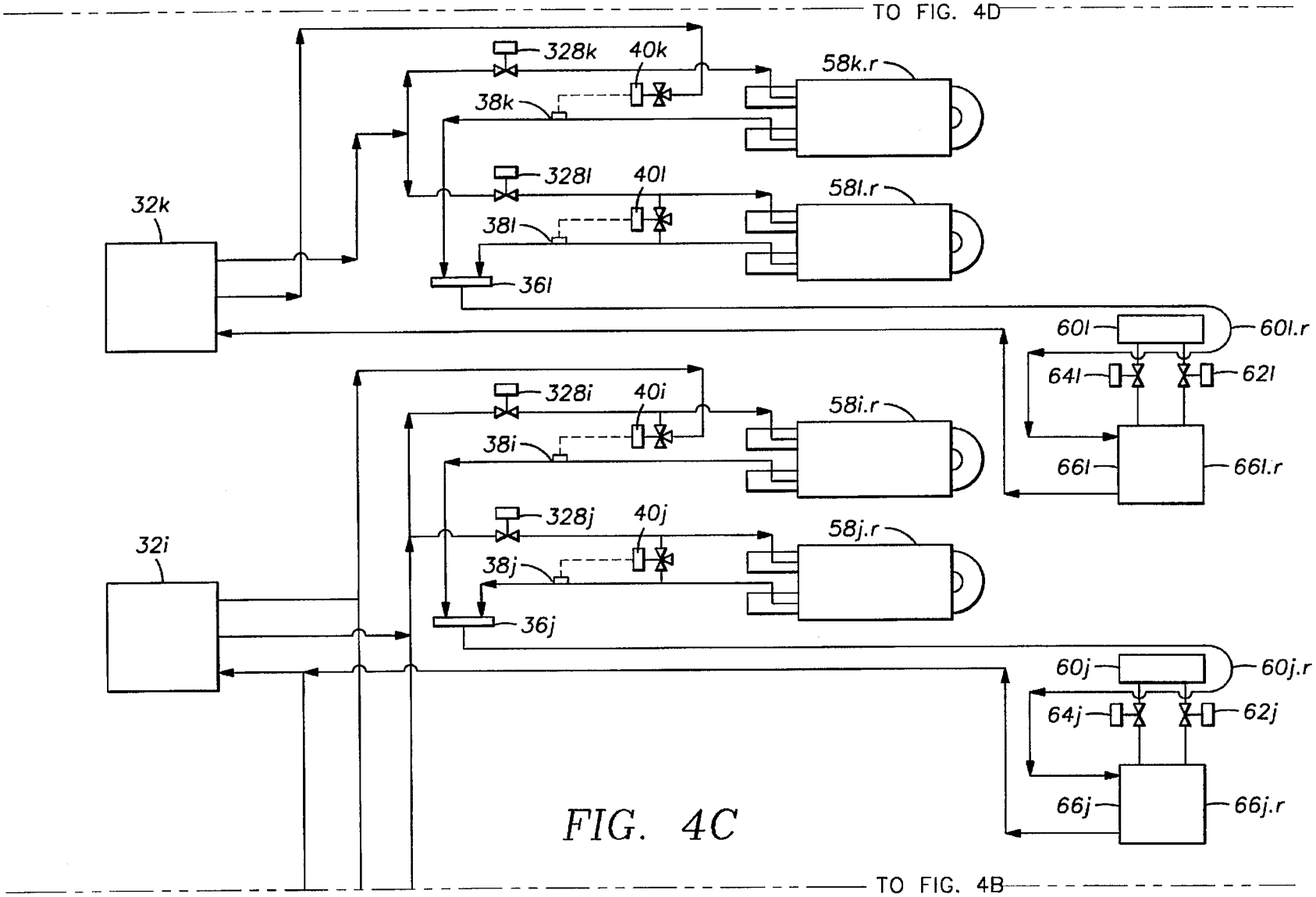

As may be seen by a comparison of FIG. 4A to FIGS. 4B and 4C, some single condenser units 32 supply refrigerating refrigerant for only one pair of the condenser columns, while a condenser unit such as 32*e* supplies refrigerating refrigerant for two pairs of the condenser columns (FIGS. 4A and 4B). Because of the increased cooling capacity required in later stages, a condenser unit 32*k* (FIG. 4C) supplies refrigerating refrigerant to the cooling coils of the condenser columns 58k.r and 581.r, and the condenser unit 32*m* (FIG. 4D) supplies refrigerating refrigerant to the cooling coils of the condenser columns 58m.r and 58n.r.

Temperature is controlled in the distillate separation chamber 60 and the distillate storage chamber 66 by controlling the superheat of the refrigerating refrigerant that is circulating around the distillate separation chamber 60 and the distillate storage chamber 66. After the refrigerating refrigerant leaves the condenser column 58, the superheating of the refrigerating refrigerant is controlled by a small temperature increase in the distillate separation chamber 60 and the distillate storage chamber 66. This small rise in temperature permits the removal of any lower boiling point refrigerants, as previously described.

Figure 4D:
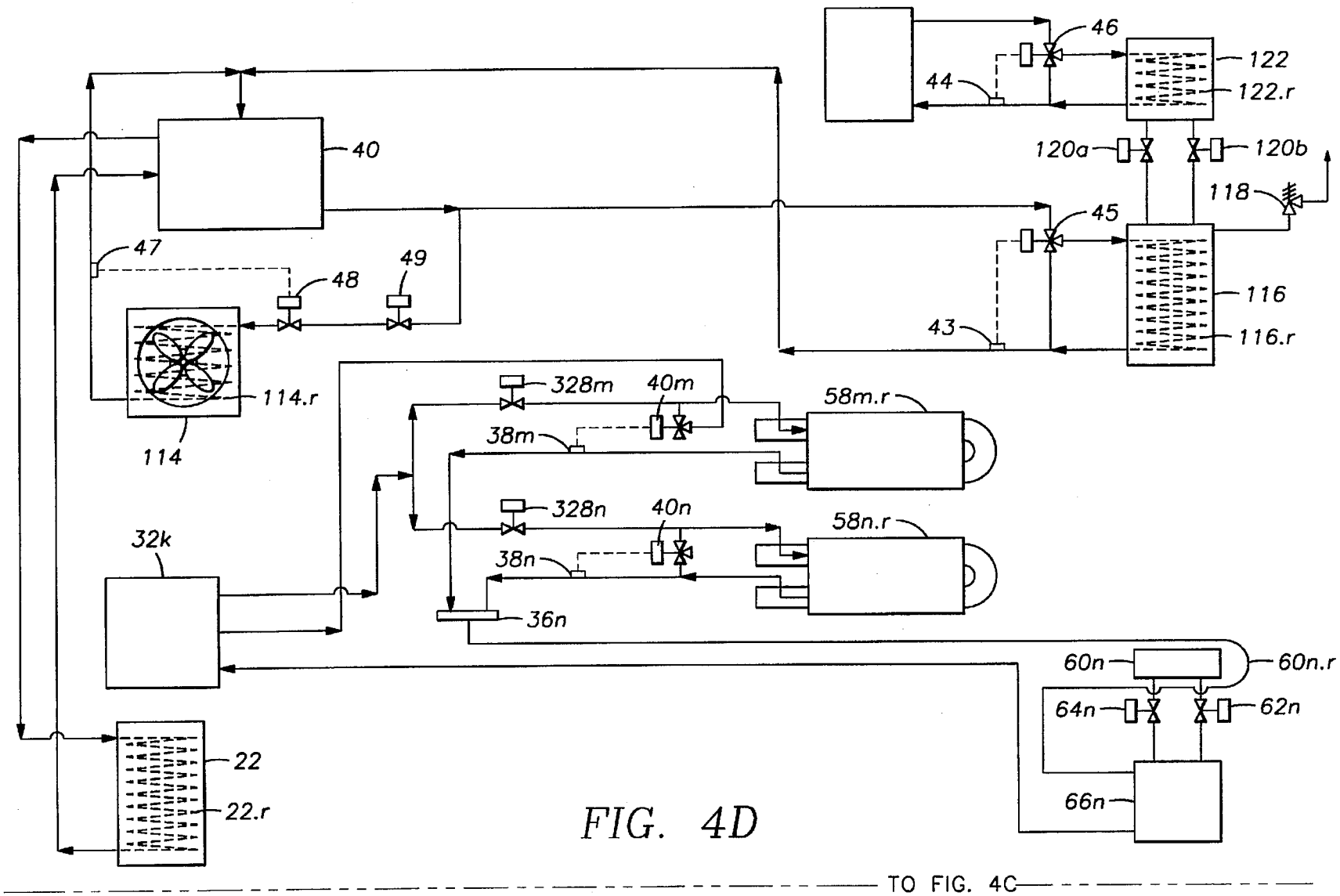

As may be seen by reference to FIG. 4D in the final stage of the system 10 the condenser unit 40 supplies the required refrigerating refrigerant to the cooling coils of the condenser chamber 116.r and the cooling coils of the desuperheating coil 114.r, as well as the cooling coils 22.r within the superheater expansion chamber 22. A separate condenser unit 42 is used to supply the coils 122.r in the non-condensible contaminant collection chamber 122. Note that the piping conducting the mixture of refrigerants to the condenser chamber 116, the non-condensible contaminant separation chamber 122 and the desuperheating coil 114 all includes expansion valves, 45, 46, 48, respectively. The operation of the expansion valves 45, 46 and 48 is controlled by the sensors, 43, 44, 47, respectively.

It will now be understood that by the foregoing disclosure, a system for decontaminating and separating out individual refrigerants from a contaminated mixture of refrigerants is disclosed. Those of ordinary skill in the art, once having read the foregoing disclosure, will understand that various changes and modifications may be made to the system of the present invention without departing from its scope. Such scope is to be defined only by the appended claims.

I claim:

1. A method for decontaminating and separating individual refrigerants from a mixture of different types of refrigerants, said mixture of different types of refrigerants being contaminated with solids, liquids and non-condensible gases, wherein said method comprises the steps of:

removing solid and liquid contaminants from the mixture of different types of refrigerants contaminated with liquids and non-condensible gases by first heating and then drying the mixture of different types of refrigerants contaminated with solids, liquids and non-condensible gases;

selectively condensing individual refrigerants, from the mixture of different types of refrigerants in a plurality of condensation stages;

removing non-condensible contaminants from the mixture of different types of refrigerants.

2. The method as defined in claim 1 wherein the step of removing solid and liquid contaminants by first heating and then drying the mixture of different types of refrigerants contaminated with solids, liquids and non-condensible gases includes:

distilling the mixture of different types of refrigerants and removing the solid and liquid contaminants obtained from said distillation process;

superheating the vaporous mixture of different types of refrigerants.

3. The method is defined in claim 1 wherein the step of selectively condensing individual refrigerants from the mixture of different types of refrigerants further includes:

controlling the flow volumes of refrigerant passing through said plurality of condensation stages;

removing heat from the mixture of different types of refrigerants with said refrigerant from a condensing unit to produce an individual refrigerant distillate;

separating said individual refrigerant distillate;

producing an electrical signal corresponding to the temperature of the mixture of different types of refrigerants;

producing an electrical signal corresponding to the pressure of the mixture of different types of refrigerants;

receiving said electrical signals with a controller, said controller further producing an electrical signal based on said received electrical signals;

controlling the flow of refrigerant from said condensing unit to said plurality of condensations stages by said electrical signals produced by said controller.

4. The method as defined in claim 1 wherein the step of removing non-condensible contaminants from the mixture of different types of refrigerants further includes:

storing the vaporous mixture of different types of refrigerants;

compressing said vaporous mixture of different types of refrigerants the;

condensing said vaporous mixture of different types of refrigerants;

purging said condensed vaporous mixture of different types of refrigerants of non-condensible contaminants;

receiving said non-condensible contaminants in a chamber.

5. A method for decontaminating and separating individual refrigerants from a mixture of different types of refrigerants, said mixture of different types of refrigerants being contaminated with solids, liquids and non-condensible gases, wherein said method comprises the steps of:

removing solid and liquid contaminants from the mixture of different types of refrigerants contaminated with solids, liquids and non-condensible gases, said step of removing solid and liquid contaminants further including:

distilling the mixture of different types of refrigerants and removing the solid and liquid contaminants obtained from said distillation process;

superheating the vaporous mixture of different types of refrigerants;

drying said vaporous mixture of different types of refrigerants;

selectively condensing individual refrigerants from the mixture of different types of refrigerants in a plurality of condensation stages said step of condensing individual refrigerants further including:

controlling the flow volume of refrigerant passing through said condensation stages;

removing heat from the mixture different types of refrigerants with refrigerant from a condensing unit to produce an individual refrigerant distillate;

separating said individual refrigerant distillate;

producing an electrical signal corresponding to the temperature of the mixture of different types of refrigerants;

producing an electrical signal corresponding to the pressure of the mixture of different types of refrigerants;

receiving said electrical signals with a controller, said controller further producing an electrical signal based on said received electrical signal;

controlling the flow of refrigerant from said condensing unit by said electrical signal produced by said controller;

removing non-condensible contaminants from the mixture of different types of refrigerants.

6. A method for decontaminating and separating individual refrigerants from a mixture of different types of refrigerants, said mixture of different types of refrigerants being contaminated with solids, liquids, and non-condensible gases, wherein said method comprises the steps of:

removing the solid and liquid contaminates from the mixture of different types of refrigerants contaminated with solids, liquids and non-condensible gases, said step of removing solid and liquid contaminants further including:

distilling the mixture of different types of refrigerants and removing the liquid contaminates obtained from said distillation process;

superheating the vaporous mixture of different types of refrigerants;

drying the vaporous mixture of different types of refrigerants;

selectively condensing individual refrigerants from the mixture of different types of refrigerants in a plurality of condensation stages, said step of selectively condensing individual refrigerants further including:

controlling the flow volume of refrigerant passing through said condensation stages;

removing heat from the mixture of different types of refrigerants with refrigerant from a condensing unit to produce an individual refrigerant distillate;

separating said individual refrigerant distillate;

producing an electrical signal corresponding to the temperature of the mixture of different types of refrigerants;

producing an electrical signal corresponding to the pressure of the mixture of different types of refrigerants;

receiving said electrical signals with a controller, said controller further producing an electrical signal based on said received electrical signals;

controlling the flow of refrigerant from said condensing unit by said electrical signal produced by said controller;

removing non-condensible contaminants from the mixture of different types of refrigerants, said step of removing non-condensible contaminants further including:

storing the vaporous mixture of different types of refrigerators;

compressing said vaporous mixture of different types of refrigerants;

condensing said vaporous mixture of different types of refrigerants;

purging said condensed vaporous mixture of different types of refrigerants of non-condensible contaminants;

receiving said non-condensible contaminants in a chamber.

7. A method for decontaminating and separating individual refrigerants from a mixture of different types of refrigerants, said mixture of different types of refrigerants being contaminated with solids, liquids, and non-condensible gases, said method comprising the steps of:

removing solid and liquid contaminants from the mixture of different types of refrigerants contaminated with solids, liquids and non-condensible gases;

selectively condensing individual refrigerants from the mixture of different types of refrigerants and a plurality of condensation stages, said step of selectively condensing individual refrigerants further including:

controlling the flow volume of refrigerant passing through said condensation stages;

removing heat from the mixture of different types of refrigerants with refrigerant from a condensing unit to produce an individual refrigerant distillate;

separating said individual refrigerant distillate;

producing an electrical signal corresponding to the temperature of the mixture of different types of refrigerants corresponding to the pressure of the mixture of different types of refrigerants;

receiving said electrical signals with a controller, said controller further producing an electrical signal based on said received electrical signals;

controlling the flow of refrigerant from said condensing unit by said electrical signal produced by said controller;

removing non-condensible contaminants from the mixture of refrigerants, said step of removing non-condensible contaminants further including:

storing the vaporous mixture of different types of refrigerants;

compressing said vaporous mixture of different types of refrigerants;

condensing said vaporous mixture of different types of refrigerants;

purging said condensed vaporous mixture of different types of refrigerants of non-condensible contaminants;

receiving said non-condensible contaminants in a chamber.

* * * * *